US005568010A

United States Patent [19]

Cha et al.

[11] Patent Number: 5,568,010

[45] Date of Patent: Oct. 22, 1996

[54] CATHODE RAY TUBE WITH IMPROVED YOKE CLAMP

[75] Inventors: Chin Y. Cha, Bloomfield; Shridhar V. Iyer, Ann Arbor, both of Mich.

[73] Assignee: Philips Electronics North America Corporation, New York, N.Y.

[21] Appl. No.: 558,516

[22] Filed: Nov. 16, 1995

[51] Int. Cl.[6] ..... H01J 29/70; H01J 29/74

[52] U.S. Cl. ..... 313/440; 313/438

[58] Field of Search ..... 313/440, 438, 313/482; 348/829, 831; 335/210, 213, 296; 358/248

[56] References Cited

U.S. PATENT DOCUMENTS

| | | | |
|---|---|---|---|
| 3,921,110 | 12/1975 | Ishii et al. | 335/210 |
| 4,064,543 | 12/1977 | Phillips | 313/440 X |
| 4,453,921 | 6/1984 | Venturi | 358/248 |
| 4,556,857 | 12/1985 | Legail | 313/440 X |
| 5,347,366 | 9/1994 | Ham | 313/440 X |
| 5,350,968 | 9/1994 | Kwon | 313/440 |

OTHER PUBLICATIONS

Philips Data Handbook, Electron tubes Book T5, 1988, Cathode–Ray tubes.

*Primary Examiner*—Sandra L. O'Shea
*Assistant Examiner*—Mack Haynes
*Attorney, Agent, or Firm*—John C. Fox

[57] ABSTRACT

The deflection coil for a cathode ray tube is secured to the outside of the glass envelope of the tube via a yoke assembly including a yoke clamp having a band which encircles the assembly and is adjusted to securely hold the assembly in place. Dividing the band into sub bands separated by a space along substantially the entire length of the band significantly reduces the stress on the neck of the glass envelope of a cathode ray tube, thereby reducing the incidences of tube failures due to neck cracking.

6 Claims, 8 Drawing Sheets

CATHODE RAY TUBE WITH IMPROVED YOKE CLAMP

BACKGROUND OF THE INVENTION

This invention relates to cathode ray tubes (CRTs), of the type having an external deflection coil for causing deflection of the beams emanating from the electron gun inside the neck of the CRT, and more particularly relates to the means for attaching the deflection coil to the CRT.

CRTs for color television are being manufactured in larger sizes than ever before, from 27 V up to 40 V ("V" conventionally indicating the diagonal dimension of the screen in inches). Such large size tubes present special problems for the manufacturer. Notable among these problems are those arising from the stresses inherent in or induced in the continuous glass envelope of the CRT during the manufacturing process.

Primarily for reasons of convenience and economy, it is preferred to attach the deflection coil to the envelope of the CRT using a mechanical clamping means. However, particularly in the larger tube sizes, it has been found that such clamping means can induce cracks in the interior or exterior surface of the glass envelope in the vicinity of the coil, leading to rejection of the tube by the manufacturer. Such rejects are particularly costly because they occur only after completion of the CRT manufacturing process. In such instances, it is generally more difficult to salvage portions of the rejected CRT for reuse than if rejection occurred earlier in the manufacturing process.

OBJECTS AND SUMMARY OF THE INVENTION

Accordingly, it is a principal object of the invention to provide a means for securing the deflection coil to the CRT, which means is less likely to induce cracks in the glass envelope of the CRT.

It is another object of the invention to provide such a means which is both convenient and economical to use in the manufacturing process.

It is yet another object of the invention to provide a CRT with a deflection coil secured to the CRT by mechanical clamping means similar to those used in the prior art, but causing reduced stress in the glass envelope of the CRT.

In accordance with the invention, there is provided a CRT having a glass envelope and including a deflection coil mounted on the outside of the glass envelope, the deflection coil mounted via a mounting assembly including a clamp comprising a band encircling the assembly (the yoke, mounting assembly and clamp herein collectively referred to as the "yoke assembly"), the clamp securing the assembly to the envelope, the clamp including means for adjustably securing the ends of the band, characterized in that the band is divided into a plurality of sub bands which are separated from one another along substantially the entire length of the band, whereby the stresses induced in the glass envelope in the region of the clamp are reduced.

In the preferred embodiment described herein, the ends of the band terminate in upstanding tabs, the tabs facing each other, and the adjustable securing means is attached to the tabs, whereby adjustment of the securing means changes the distance between the tabs and consequently changes the size of the clamp, to thereby adjust the pressure of the clamp on the assembly. Adjustment which brings the tabs closer together forces the band against the assembly, in turn forcing the assembly against the outer surface of the glass envelope of the CRT, thereby securing the assembly to the CRT.

In the preferred embodiment described herein, the tabs are apertured, and the apertures are aligned, and the adjustable securing means consists of a bolt having a threaded portion passing through the apertures, and a nut securing the bolt to the clamp.

The sub bands are preferably of approximately equal width, and are preferably spaced apart by a distance which is less than the width of a sub band.

The invention will be further described in conjunction with the drawings, in terms of two examples of a 32 V CRT with a yoke assembly, one having a clamp of the prior art and the other having a clamp of the invention.

DESCRIPTION OF THE PREFERRED EMBODIMENTS

Figure 1:
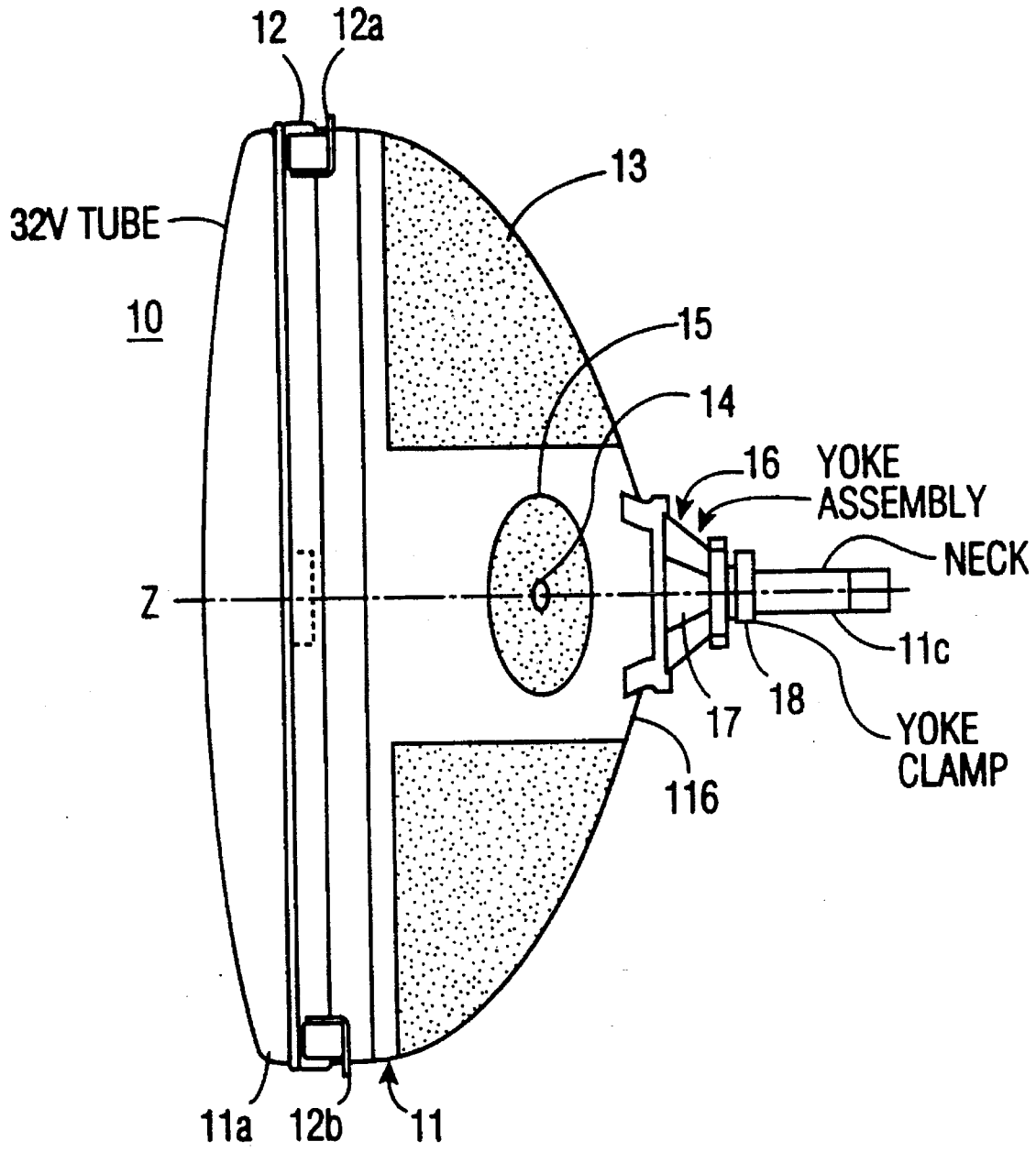
FIG. 1 is a side elevation view of a CRT of the type used for color television, including a yoke assembly secured to the outside of the CRT's glass envelope.

FIG. 1 is a side elevation view of a 32 V CRT 10 of the type used for color television, having a glass envelope 11, including a front display panel 11*a*, a funnel 11*b*, a neck 11*c*, and a transition region between the funnel and the neck, which is obscured by the yoke assembly 16. Yoke assembly 16 includes a deflection coil 17, and yoke clamp 18, which secures the assembly to the CRT envelope. Implosion protection band 12, including CRT mounting ears 12*a* and 12*b*, high voltage anode button 14, and resistive coatings 13 and 15, are also illustrated in this Figure.

Figure 2C:
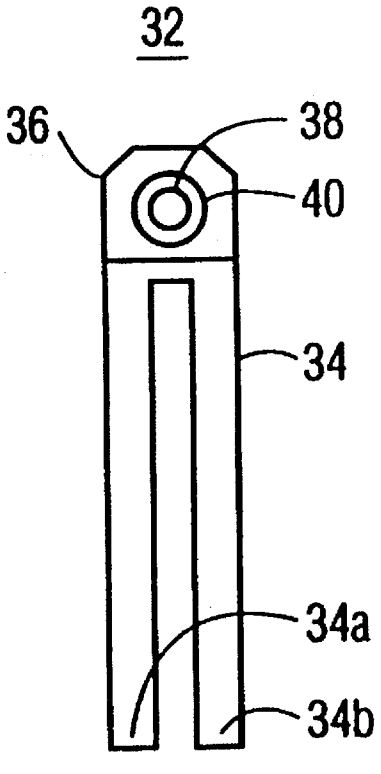
FIGS. 2*a* through *c* are, respectively, a side view of a yoke clamp of the prior art, a front view of both the yoke clamp of the prior art and the yoke clamp of the invention, and a side view of a yoke clamp of the invention.
Figure 2B:
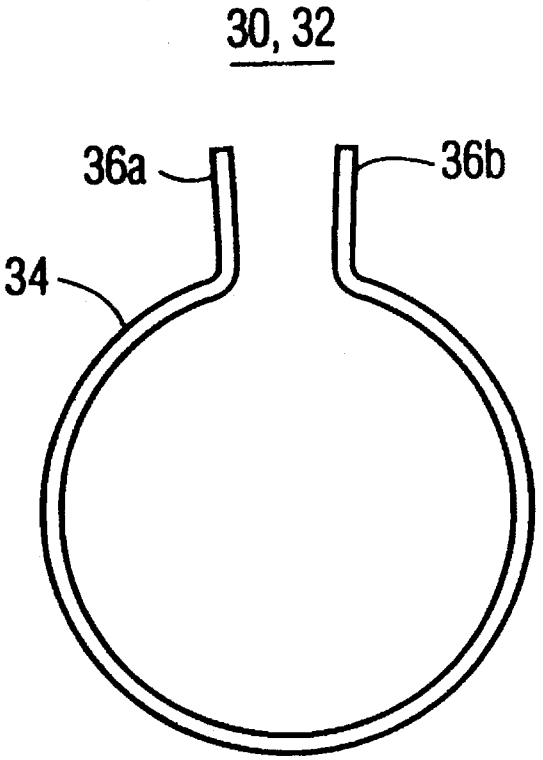
Figure 2A:
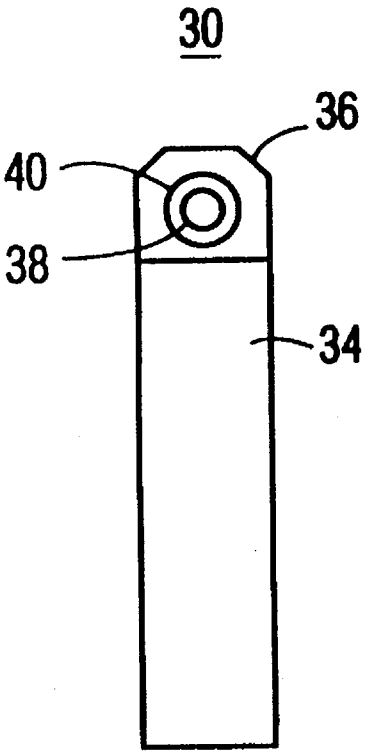
FIG. 2a PRIOR ART

FIGS. 2*a* through 2*c* are, respectively, a side view of a yoke clamp 30 of the prior art, a front view of both the yoke clamp 30 of the prior art and a yoke clamp 32 of the invention, and a side view of the yoke clamp 32 of the invention. These two yoke clamps are similar in that both include a band 34, the ends of which each terminate in an upstanding tab (36*a*, 36*b*), which tabs define central apertures 38 and 40, and face one another in the manner shown so that the apertures 38 and 40 are aligned. An adjustable securing means such as a threaded nut and bolt, not shown, engages the apertures and during assembly draws the tabs toward each other, thereby to tighten the band 34 and the yoke assembly 16 against the neck 11*c* of the CRT 10 in the known manner.

The yoke clamp 32 of FIG. 2*c* has its band 34 divided into two sub bands 34*a* and 34*b*, which are separated by a space along substantially the entire length of the band.

Figure 3A:
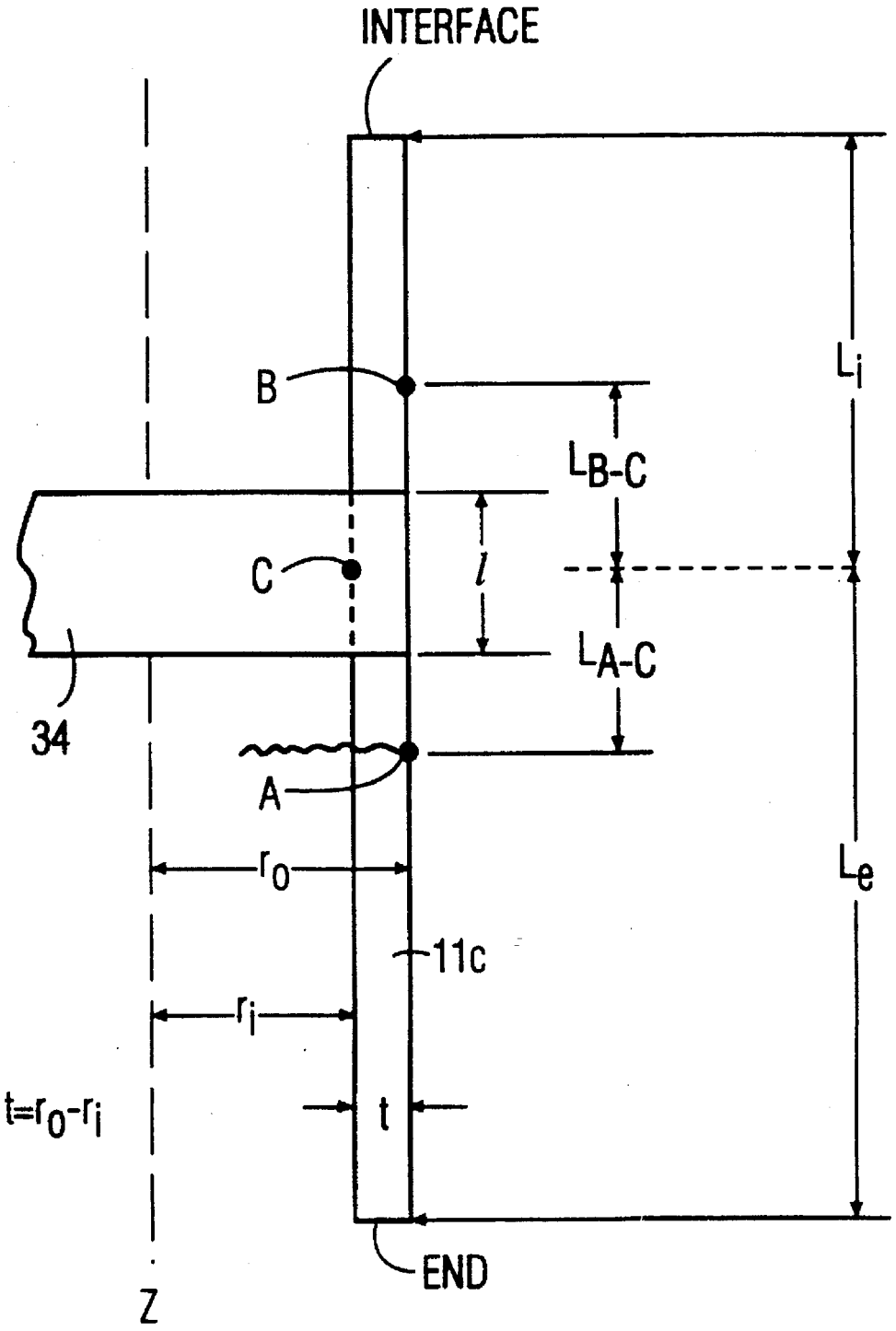
FIGS. 3*a* and 3*b* illustrate boundary element models for the neck of a 32 V CRT, including a yoke clamp of the type shown in FIG. 2*a* and a yoke clamp of the invention shown in FIG. 2*b*, respectively.
Figure 3B:
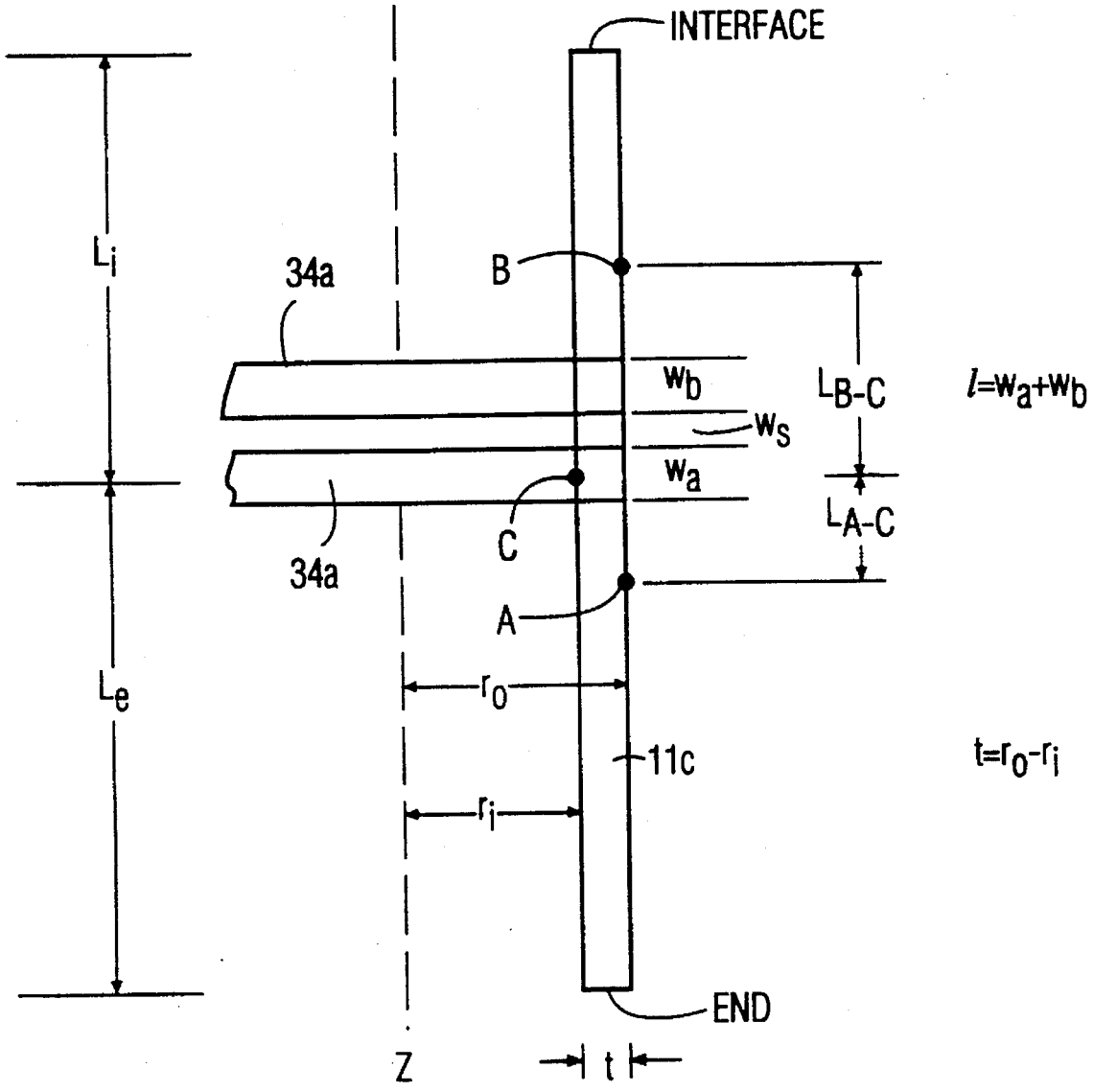

The dimensions and locations of the yoke clamps of FIGS. 2*a* and 2*c* relative to the neck of the 32 V CRT are shown in the boundary element models of FIGS. 3*a* and 3*b*, respectively. In these illustrative examples, the neck 11*c* has a length $L_i+L_e$ of 2.364 inches, an inner radius $r_i$ of 0.451 inches, an outer radius $r_o$ of 0.576 inches, and a neck thickness t of 0.126 inches. The clamp of FIG. 2*a* in FIG. 3*a* has a band width 1 of 0.354 inches, the center C of which is located a distance $L_i$ of 0.953 inches from the interface between the neck and the funnel transition region, and a distance $L_e$ of 1.411 inches from the opposite end of the neck. Other dimensions are as follows: $r_o$=0.576 $r_i$=0.451 inches, t=0.126 inches, $L_{AC}$ and $L_{BC}$=0.382 inches.

The band of FIG. 2*c* in FIG. 3*b* is divided into two sub bands, each having a width ($w_a$, $W_b$) of 0.1335 inches and separated by a space having a width ($w_s$) of 0.087 inches. The yoke clamp in FIG. 3*b* has the same position as the yoke clamp in FIG. 3*a*, so that the center C of sub band 34*a* is located a distance $L_i$ of 1.062 inches from the interface between the neck and the funnel transition region, and a distance $L_e$ of 1.302 inches from the end of the neck. $L_{AC}$ and $L_{BC}$ are 0.273 and 0.491 inches, respectively.

The glass breaking strength depends upon the flaw size of existing defects. Since such defects are usually found to occur in the outer glass surface, failures generally originate at the outer surface, which is consistent with the observation of neck cracking at the outer surface in 32 V CRTs; however, neck cracking at the inner surface has also been observed in 27 V CRTs.

Cracking of the 32 V CRT neck glass has been observed to propagate from point A as shown in FIG. 3*a*. In order to determine the cause of this cracking, boundary element analysis was carried out for maximum principal tensile stress at points A, B and C using an assumption of axisymmetry, which assumption is justified since the cracking is localized in the neck region of the CRT, and is not related to the pressure of the implosion protection band or the overall vacuum inside the envelope.

Material constants used for the glass at a reference temperature of 70 F are as follows:

| | |
|---|---|
| Young's modulus | 10.07 E + 6 psi |
| Poisson's ratio | 0.23 |
| Thermal conductivity | 1.4 E − 5 BTU/in-s F. |
| Thermal expansion coefficient | 5.5 E − 6 in/in F. |

The yoke clamp pressure needed for the stress analysis was determined as follows. The yoke clamps employed a screw with an ISO thread having a major diameter of 0.1575 inches and a pitch of 0.02756 inches. For a coefficient of friction of the threads of 0.12, the relationship between screw force W and clamp torque T can be expressed as $$W=T/0.0148 \quad (1)$$

Using a value for torque T of 8.851 1bf-inch in eq. (1), the screw force W was found to be 598 pounds. Equilibrating the screw force W to the tension of the yoke clamp, the yoke clamp pressure P can be expressed as $$P=W/(r_o 1) \quad (2)$$

where $r_o$ is the outer radius of the neck and 1 is the width of the band of the yoke clamp. By substituting the values of 0.576 for $r_o$, 0.354 for 1, and 598 for W, P becomes 2932 psi.

The normal force $F_n$ on the neck is then determined by the equation $$F_n=2\pi r_o 1P \quad (3)$$

By substituting the known values for $r_o$, 1 and P, then $F_n$ becomes 3756 pounds.

Substituting the same values into equations (1) through (3) for the clamp of the invention, except for the width of the band, which is $w_a+w_b$=0.267 inches, instead of 0.354 inches, the values of W and $F_n$ are the same, but the value of P is 3888 psi.

The values for both clamps are summarized in Table 1.

TABLE 1

| ITEMS | PRIOR ART YOKE CLAMP | INVENTIVE YOKE CLAMP |
|---|---|---|
| Yoke Clamp Torque | 8.851 lbf-in | 8.851 lbf-in |
| Total Width of Yoke Clamp | 0.354" | 0.354" |
| Band Width of yoke clamp | 0.354" | 0.1335 × 2 = 0.267" |
| Normal force to the neck | 3756 lb. | 3756 lb. |
| Slots Width | None | 0.0870" |
| Yoke Clamp Pressure | 2932 psi | 3888 psi |

The stress analysis results at points A, B and C of the neck for each clamp are shown in Table 2 together with the reduction in stress at each point for the clamp of the invention.

TABLE 2

| | Point C | Point A | Point B |
|---|---|---|---|
| Prior Art Yoke Clamp | 7942.8 psi | 2993 psi | 3040 psi |
| Inventive Yoke Clamp | 6328.3 psi | 2871 psi | 2925 psi |
| The amount of reduced stress | 1614.5 psi | 122 psi | 115 psi |

The breaking strength at the inner glass surface of the neck has been determined by polarimetry as 8500 psi. As seen in Table 2, the stress at point C, the center of the band width at the inner surface of the neck, is below the breaking strength, so the analysis in this respect is consistent with the observed result of no cracking at point C.

However, the stress at points A and B is about the same, so in this respect the mechanical stress analysis of the clamps is inconclusive. It is known from polarimetry analysis however, that residual stresses are present in the neck glass due to thermal treatments during manufacture, and that the residual thermal stress at point A is significant, while that around point B is negligible. Therefore, it can be concluded that the cracking at point A is the result of the combined residual thermal stress of manufacturing processing and the mechanical stress of the yoke clamp.

As may be seen, the clamp of the invention results in significantly reduced levels of stress at points A, B and C, as shown in the last line of table 2. The stresses can be reduced even further by increasing the width of the slot between sub bands.

Figure 4:
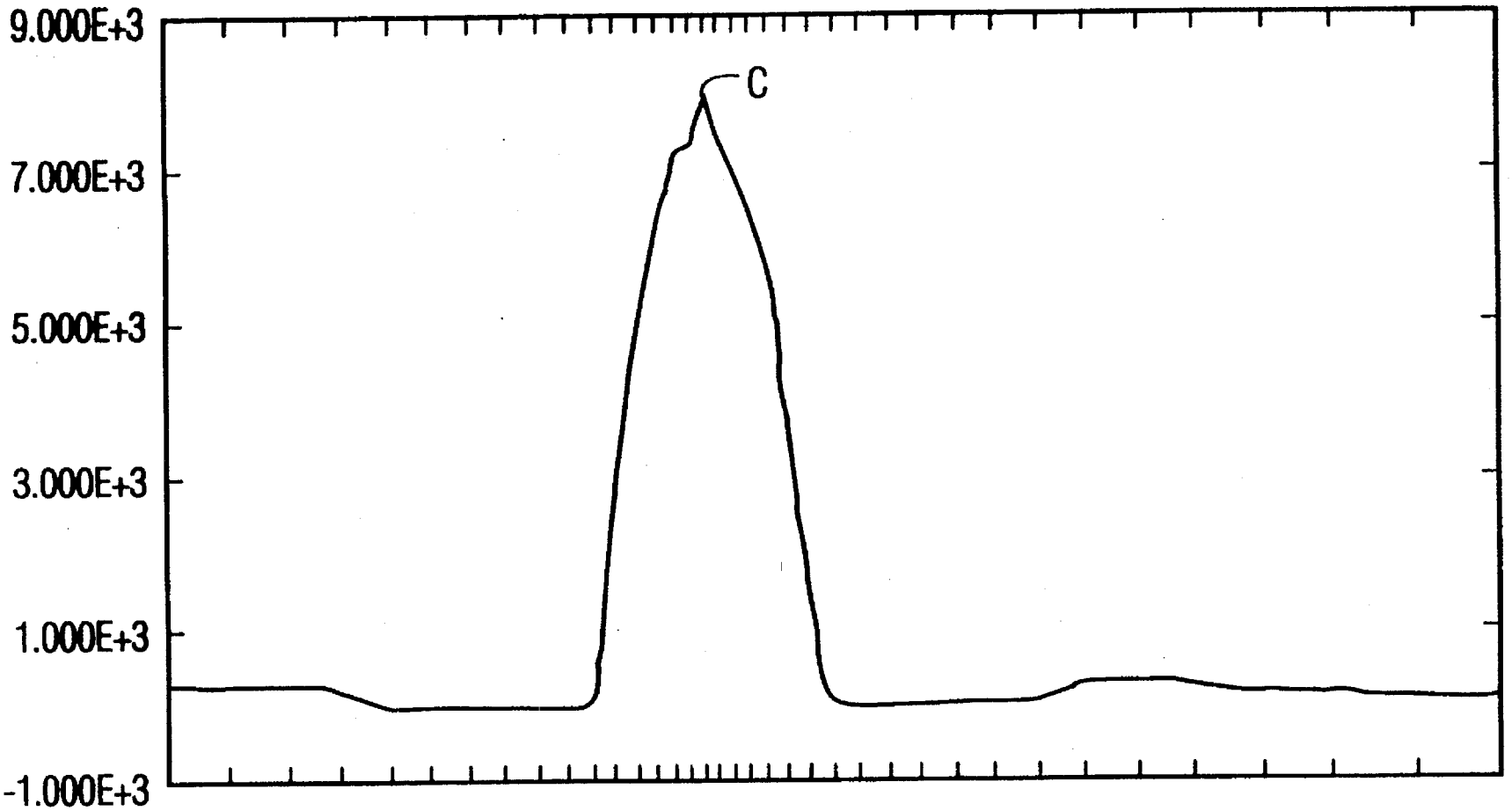
FIGS. 4 and 5 are graphical illustrations of the inner and outer stress distribution in the neck of a 32 V CRT, including a yoke clamp of the type shown in FIG. 2*a*.
Figure 5:
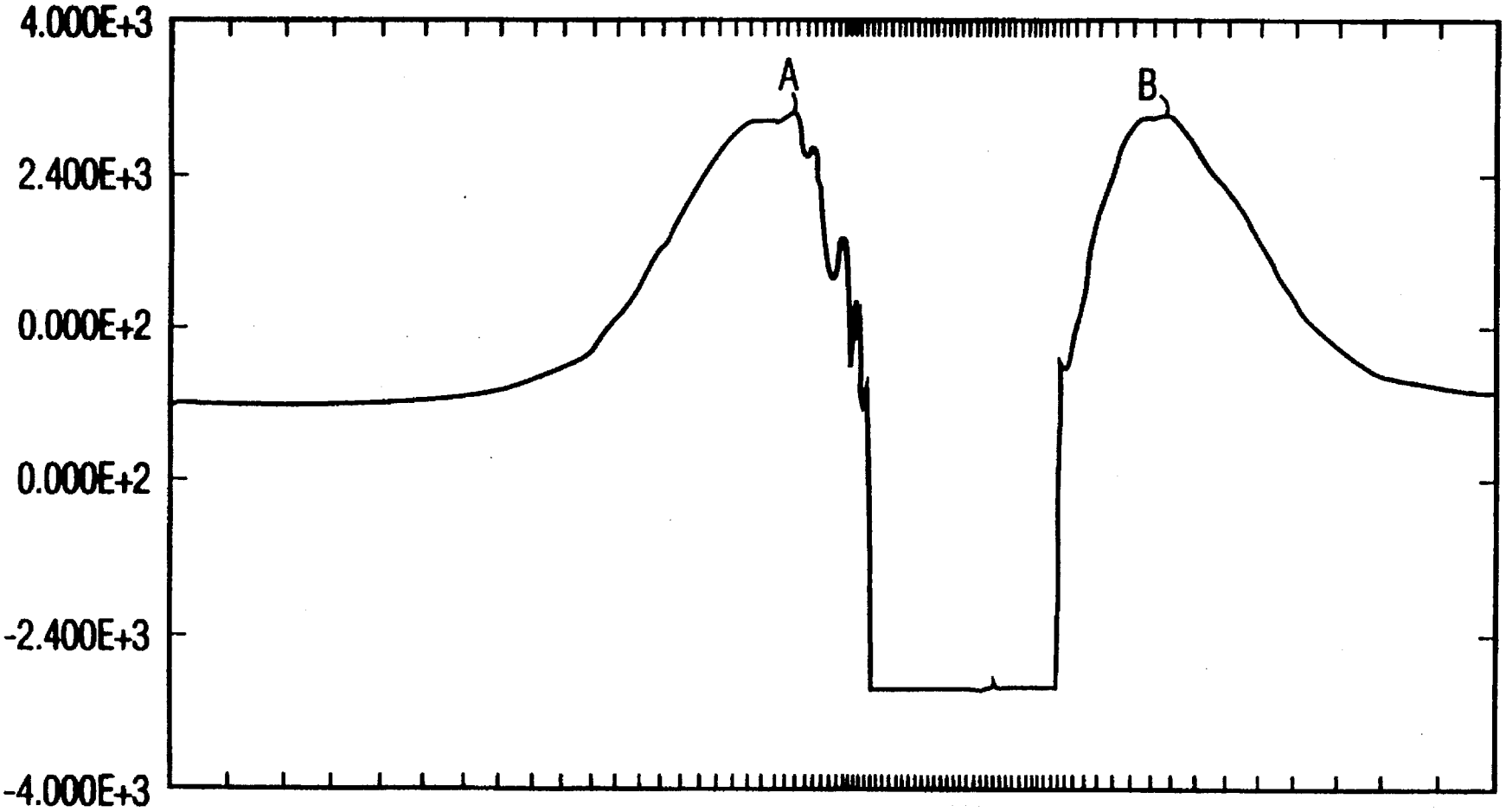
Figure 6:
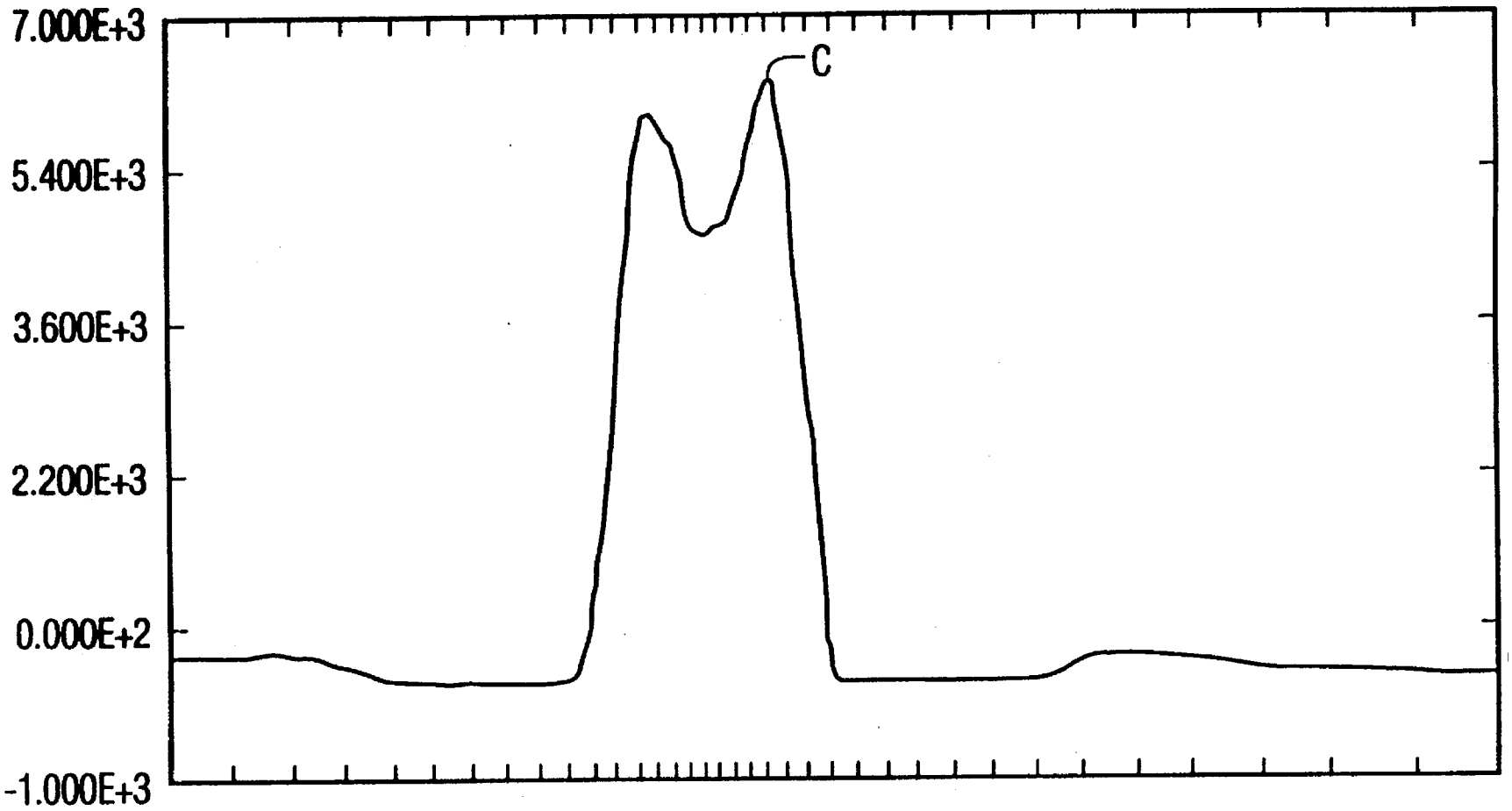
FIGS. 6 and 7 are graphical illustrations of the inner and outer stress distribution in the neck of a 32 V CRT, including a yoke clamp of the invention shown in FIG. 2*c*.
Figure 7:
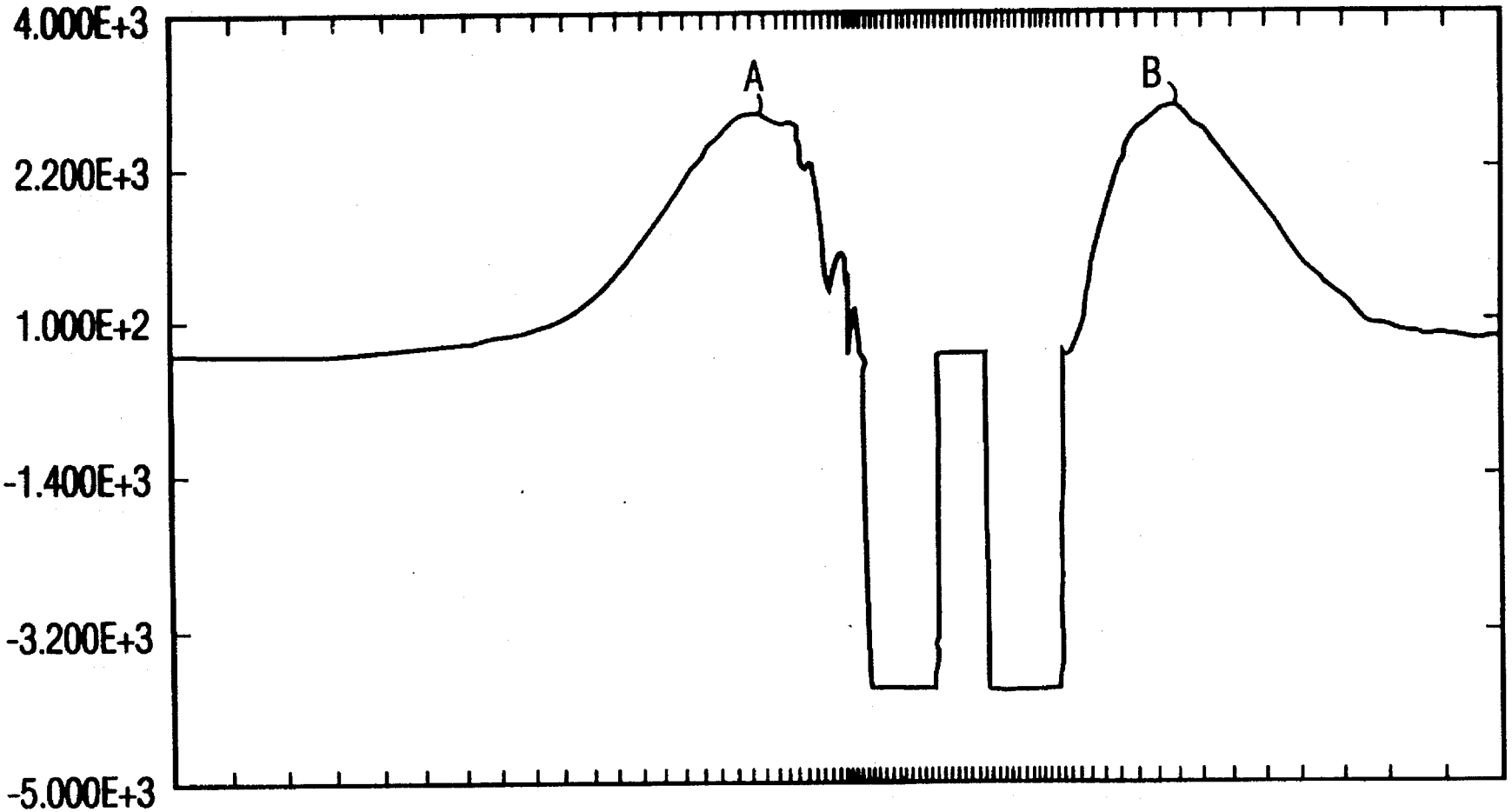

The stress distributions along the inner and outer surfaces of the neck are shown graphically in FIGS. 4 through 7, as maximum principal tensile stress in-psi versus distance along the neck, from the neck end to the neck/transition region interface for the inner surface of the neck in FIGS. 4 and 6, and from the interface to the neck end for the outer surface of the neck in FIGS. 5 and 7.

FIGS. 4 and 6 show the stress distributions of the inner stresses in the neck for a yoke clamp of the type shown in FIG. 2*a* and for a yoke clamp of the invention shown in FIG. 2*c*, respectively (where E is 10 and in is the exponent of E; for example $10+3=10^3=1000$; $10-2=10^{-2}=1/100$). In FIG. 4, the stress outside the region of the clamp is at an approximately constant level of about zero, and then abruptly rises at point C to a peak of 7942.8 psi (see Table 2). In comparison, FIG. 6 shows a somewhat similar stress level as FIG. 4 outside the region of the clamp, but a significantly lower peak stress at point C of the clamp of 6328.3 psi. In addition, since the peak stress is divided into two peaks, the peak stress is distributed over an area, rather than being concentrated in a single point as shown in FIG. 4.

FIGS. 5 and 7 show the stress distributions of the outer stresses in the neck for a yoke clamp of the type shown in FIG. 2*a* and for a yoke clamp of the invention shown in FIG. 2*c*, respectively. In FIG. 5, the stress begins at zero, rises to a peak of 2993 psi at point A just outside the region of the clamp, then drops precipitously due to the yoke clamp pressure of −2932 psi under the clamp, and then traces a symmetrical path on the other side of the clamp to a peak of 3040 psi at point B. In FIG. 7, a similar pattern occurs, except that the peak stresses at points A and B are somewhat lower, 2871 and 2925 psi, respectively, and the yoke clamp pressure is −3888 psi under the subbands.

To demonstrate further the advantages of the clamp of the invention, tests were carried out on 32 V CRTs having the clamps of FIGS. 2*a* and 2*c*, respectively, by increasing the torque T on the clamps until the neck glass cracked. Results are shown in Table 3.

TABLE 3

| | T = 8.851 lbf-in | T = 10.62 lbf-in | T = 12.39 lbf-in |
|---|---|---|---|
| Inventive Clamp | No fail | No fail | No fail |
| Prior Art Clamp | No fail | No fail | Neck crack |

As can be seen from Table 3, the CRT of the invention can withstand a yoke clamp torque T of 12.39 lbf-in without cracking of the neck glass, while the CRT of the prior art failed at this level of torque.

The invention has been described in terms of a limited number of embodiments. Other embodiments and variations of embodiments will become apparent to the skilled artisan from the above description, and these embodiments and variations are intended to be encompassed within the scope of the claims appended hereto.

What we claim as our invention is:

1. A cathode ray tube having a glass envelope and including a deflection coil mounted on the outside of the glass envelope, the deflection coil mounted via a mounting assembly including a clamp comprising a band encircling the assembly and securing the assembly to the envelope, the clamp including means for adjustably securing the ends of the band, characterized in that the band is divided into a plurality of sub bands which are separated from one another along substantially the entire length of the band, whereby the stresses induced in the glass envelope in the region of the clamp are reduced.

2. The cathode ray tube of claim 1 in which the ends of the band terminate in upstanding tabs, the tabs facing each other, and the adjustable securing means is attached to the tabs, whereby adjustment of the securing means changes the distance between the tabs and consequently changes the size of the clamp, to thereby adjust the pressure of the clamp on the assembly.

3. The cathode ray tube of claim 1 in which the tabs are apertured, and the apertures are aligned, and the adjustable securing means consists of a bolt having a threaded portion passing through the apertures, and a not securing the bolt to the clamp.

4. The cathode ray tube of claim 1 in which the sub bands are of equal width.

5. The cathode ray tube of claim 1 in which there are two sub bands.

6. The cathode ray tube of claim 5 in which the ratio of the width of a sub band to the width of the space between sub bands is about 1.5 to 1.

* * * * *